US005944100A

United States Patent [19]

Hipp

[11] Patent Number: 5,944,100

[45] Date of Patent: Aug. 31, 1999

[54] JUNK BAILER APPARATUS FOR USE IN RETRIEVING DEBRIS FROM A WELL BORE OF AN OIL AND GAS WELL

[75] Inventor: James E. Hipp, New Iberia, La.

[73] Assignee: Baker Hughes Incorporated, Houston, Tex.

[21] Appl. No.: 08/900,633

[22] Filed: Jul. 25, 1997

[51] Int. Cl.[6] ..... E21B 31/08

[52] U.S. Cl. ..... 166/99; 166/66.5

[58] Field of Search ..... 166/311, 99, 66.5, 166/105.3, 105.4; 294/86.11, 86.15, 86.23

[56] References Cited

U.S. PATENT DOCUMENTS

| | | | |
|---|---|---|---|
| 2,384,090 | 9/1945 | Hartsell | 166/99 |
| 3,023,810 | 3/1962 | Anderson | 166/99 |
| 3,203,491 | 8/1965 | Turley | 166/99 |
| 3,406,757 | 10/1968 | Baumstimler | 166/99 |
| 3,651,867 | 3/1972 | Baumstimler | 166/99 |
| 3,946,819 | 3/1976 | Hipp | 175/296 |
| 4,059,155 | 11/1977 | Greer | 166/99 |
| 4,462,471 | 7/1984 | Hipp | 175/296 |
| 4,702,325 | 10/1987 | Hipp | 173/64 |
| 4,958,691 | 9/1990 | Hipp | 175/296 |
| 5,156,223 | 10/1992 | Hipp | 175/296 |

*Primary Examiner*—William Neuder

[57] ABSTRACT

An apparatus for removing debris from an oil and gas well is operable with fluid pressure that reciprocates a valving member between upper and lower positions. The valving member seals against a piston in a lowermost position so that the fluid pressure can be used to move both valve member and piston downwardly. The valving member has a valving member spring that, when fully compressed, separates the valving member and piston. Once the valving member and piston are separated, the piston is no longer supported in the lowermost position because fluid pressure is relieved through the piston bore. A piston spring then thrusts the piston upwardly, causing it to pump fluid from a position outside the lower end of the tool body through an intake portion into a cavity, pulling debris therewith. Pivoting flexible finger members or brushes are positioned at the lower end of the tool body and are moveable between open and closed positions for intaking the debris when in the opened position and for trapping debris when in the closed position. Staging magnets are attached to the body of the tool. The flexible fingers or brushes move the debris from magnet to magnet in stages, finally reaching a storage area.

22 Claims, 7 Drawing Sheets

JUNK BAILER APPARATUS FOR USE IN RETRIEVING DEBRIS FROM A WELL BORE OF AN OIL AND GAS WELL

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to downhole oil and gas well tools and particularly to an improved junk bailer apparatus that can remove debris and/or "junk" from a well bore. Even more particularly, the present invention relates to an improved "junk" bailer apparatus that features a reciprocating pumping action combined with catch fingers and flexible brush "escalator" members to pump debris into a tool body cavity and then hold the debris or junk within the cavity using the catch fingers. In one embodiment, magnetic members and multiple sets of fingers define an "escalator" that gradually intakes debris and transports it farther and farther into the tool body cavity. Staging magnets are attached to the body of the tool and are exposed to the lower chamber by a slot in the lower piston. The flexible fingers or brushes move the debris from magnet to magnet in stages, finally reaching a storage area.

2. General Background of the Invention

Various "junk" bailers are commercially available for removing debris or junk from an oil and gas well bore. Some of these prior art bailers use a venturi-type pumping arrangement that is often inefficient. Other bailers use hydrostatic pressure to force "junk" or debris into a tool housing when a valve is opened or a disk is ruptured after the tool is placed downhole.

In prior U.S. Pat. No. 3,946,819, naming the applicant herein as patentee, there is disclosed a fluid operated well tool adapted to deliver downward jarring forces when the tool encounters obstructions. The tool of my prior U.S. Pat. No. 3,946,819, generally includes a housing with a tubular stem member telescopically received in the housing for relative reciprocal movement between a first terminal position and a second terminal position in response to fluid pressure in the housing. The lower portion of the housing is formed to define a downwardly facing hammer and the stem member includes an upwardly facing anvil which is positioned to be struck by the hammer. The tool includes a valve assembly that is responsive to predetermined movement of the stem member toward the second terminal position to relieve fluid pressure and permit the stem member to return to the first terminal position. When the valve assembly relieves fluid pressure, the hammer moves into abrupt striking contact with the anvil.

In prior U.S. Pat. No. 4,462,471, naming the applicant herein as patentee, there is provided a bidirectional fluid operated jarring apparatus that produces jarring forces in either the upward or downward direction. The jarring apparatus was used to provide upward or downward impact forces as desired downhole without removing the tool from the well bore for modification. The device provides downward jarring forces when the tool is in compression, as when pipe weight is being applied downwardly on the tool, and produces strong upward forces when is in tension, as when the tool is being pulled upwardly.

In the '471 patent, there is disclosed a jarring or drilling mechanism that may be adapted to provide upward and downward blows. The mechanism of the '471 patent includes a housing having opposed axially spaced apart hammer surfaces slidingly mounted within the housing between the anvil surfaces. A spring is provided for urging the hammer upwardly.

BRIEF SUMMARY OF THE INVENTION

The present invention provides an improved bailer apparatus for removing debris from an oil and gas well having a well bore.

The apparatus includes an elongated, preferably cylindrically-shaped tool body having upper and lower end portions, a cylindrically-shaped sidewall, and an elongated longitudinally extended central flow bore for conveying fluids from the surface area via a coiled tubing unit, work string or the like to the tool body and through the tool body.

A connector is provided for attaching the upper portion of the tool body to a work string, coiled tubing unit or the like, using a threaded connection, for example.

The lower end portion of the tool body provides a cavity for holding debris once removed from the well bore.

An intake portion is positioned at the lower end portion of the tool body for enabling debris to travel from the well bore to the cavity via the intake portion.

A closure member is positioned at the intake portion for closing the cavity so that debris that enters the cavity is retarded from leaving the cavity via the intake portion.

In the preferred embodiment, the closure member is in the form of multiple flexible fingers that move between opened and closed positions. A valve and piston arrangement defines a pumping mechanism for sequentially generating a mass of flowing fluid from the exterior of the well bore through the intake portion and into the cavity.

Slots or openings in the sidewall enable fluid to exit the cavity so that the debris is trapped within the cavity.

The pumping arrangement includes a lowermost piston slidably mounted within the bore and movable between upper and lower positions. A movement of the piston from a lower position to the upper position generates a mass of flowing fluid that flows from the well bore just below the intake portion to the cavity for carrying debris therewith.

The piston is operable to move from the lower position to the upper position with a piston spring. The piston is operable to move from the upper position to the lower position with pressurized fluid that is transmitted to the tool body bore using the work string, coil tubing unit or the like.

A valve member controls the flow of pressurized fluid to the piston thus controlling when the piston is activated to move from the upper position to the lower position.

When the valve member is not sealed against the piston, pressurized fluid is unable to hold the valve member in the lower position and a piston spring thrusts the piston from the lower position to the upper position. The valve member also provides a spring in the form of a compressible valve member spring.

When pressurized fluid is introduced via the coiled tubing unit, work string or the like, it first moves the valving member from its upper position to a lower position. This travel of the valving member from the upper position to the lower position gradually compresses the valve member spring.

To start operation the valve member is positioned on the piston to form a seal therewith so that pressurized fluid above the valve member and piston can be used to move the assembly of valve member and piston downwardly to the lowermost position.

However, when the valve member spring is fully compressed, it then contains sufficient strength to separate the valve member from the piston. Once the valve member and piston are separated, fluid escapes through a piston bore and relieves pressure on the piston. This enables the piston spring to thrust the piston back to the upper position which creates the pumping action that pulls debris from the well bore into the cavity.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
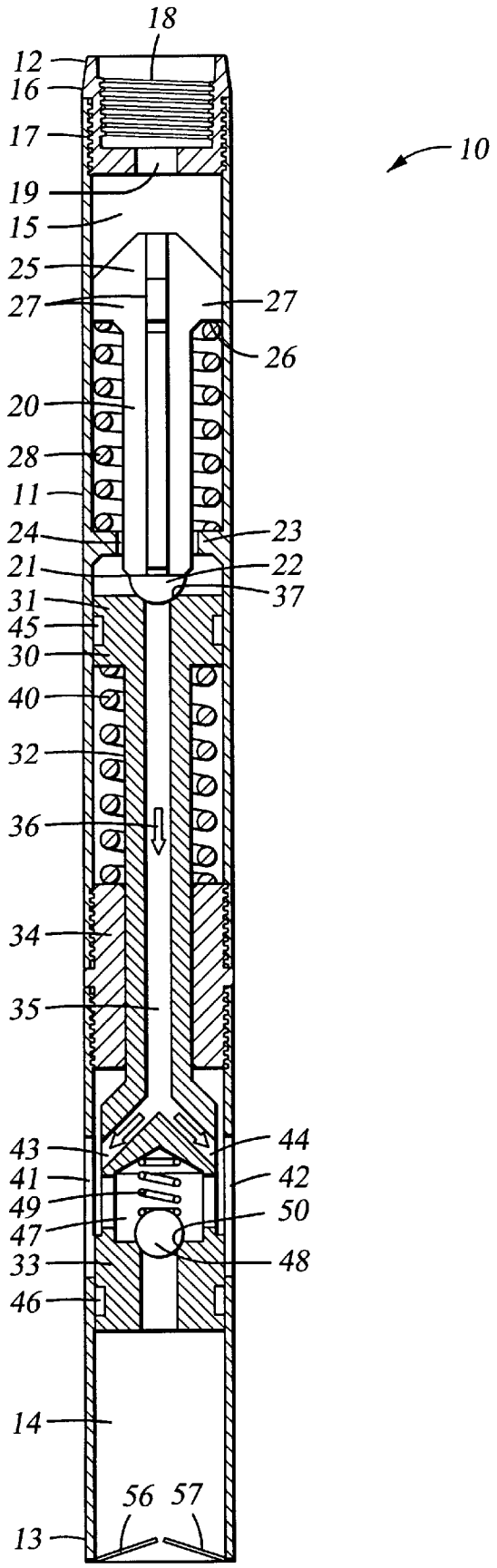
FIG. 1 is a sectional elevational view of the preferred embodiment of the apparatus of the present invention shown in the initial position with the tool operating to circulate fluids, prior to beginning pump operation.
Figure 2:
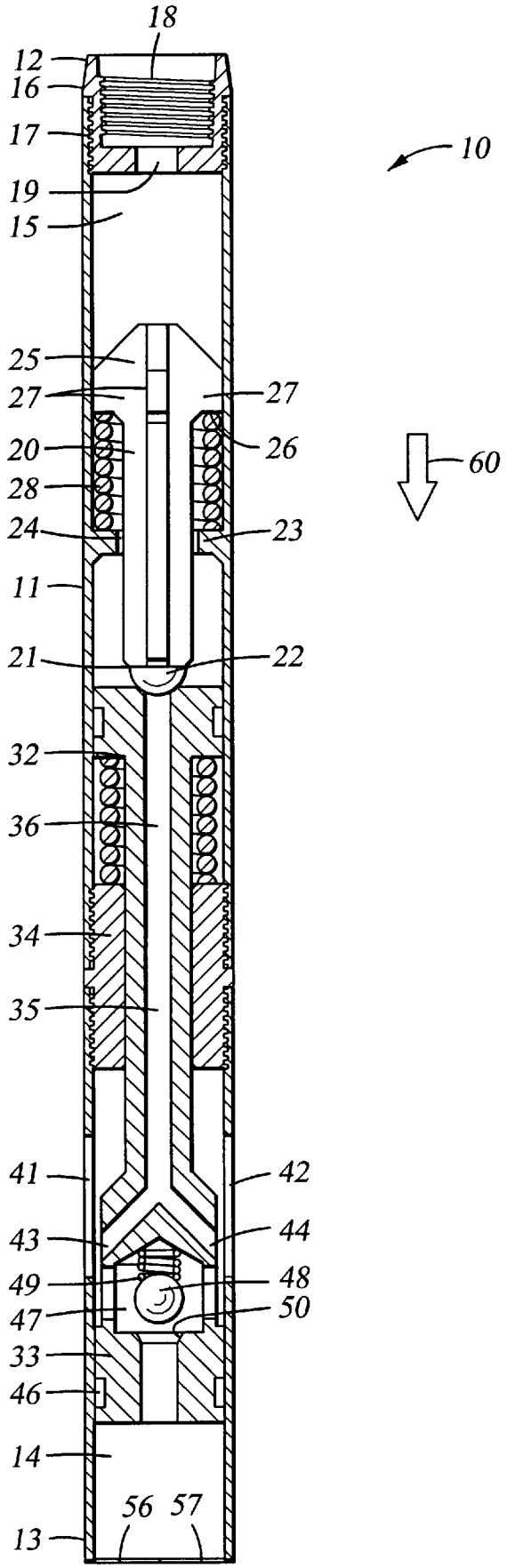
FIG. 2 is a sectional elevational view of the preferred embodiment of the apparatus of the present invention illustrating the initiation of pump operation wherein the valving member and piston are in a lowermost position.
Figure 3:
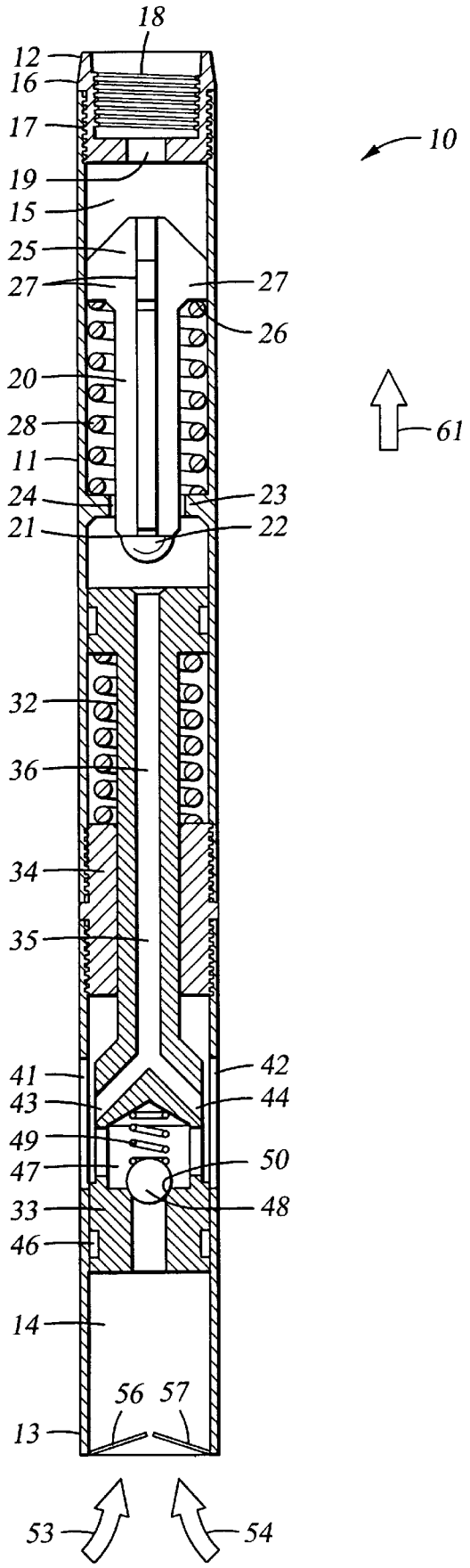
FIG. 3 is a sectional elevational view of the preferred embodiment of the apparatus of the present invention illustrating a completion of the pumping cycle wherein the valving member and piston have returned to the initial position.

FIGS. 1–3 show generally the preferred embodiment of the apparatus of the present invention designated generally by the numeral 10.

Junk bailer apparatus 10 includes an elongated tool body 11 that can be run in an oil and gas well bore such as in well casing, for example. Tool body 11 has an upper end portion 12 and a lower end portion 13. The lower end portion 13 provides an open ended intake portion for receiving debris during use.

The tool body 11 provides a longitudinally extended open ended bore 15 that communicates with the upper and lower end portions 12, 13 and which contains moving parts such as the valving member 20, piston 31, and hinged catch fingers 56, 57.

Upper end portion 12 of tool body 11 has a fitting 16 that forms a threaded connection 17 with the tool body 11 as shown in FIGS. 1–3. Fitting 16 also provides internal threads 18 for attaching the entire assembly of junk bailer apparatus 10 to a coiled tubing unit, drill string, work string, or the like, enabling the apparatus 10 to be lowered into a well bore for removing debris therefrom. Fitting 16 provides a flow port 19 so that a coil tubing unit, work string, or the like can communicate with the bore 15 of tool body 11 so that fluids can flow from the earth's surface to the tool body 11 via port 19 and bore 15.

A valving member 20 is mounted in bore 15 of tool body 11 at upper end portion 12 as shown in FIG. 1. Valving member 20 has a lower end portion 21 that defines a ball valving member 22. Tool body 11 has an annular shoulder 23 with an opening 24 through which the middle and lower end portions of valving member 20 can pass during use. Valving member 20 has an enlarged upper end portion 25 that has shoulders 26 that engage coil spring 28. The valving member 20 can be "X" shaped in transverse section, comprising a plurality of preferably four (4) longitudinally extending ribs 27. When the valving member 20 reaches a lowermost position as shown in FIG. 2, spring 28 is compressed and the shoulders 26 prevent further downward movement of valving member 20 in the direction of arrow 60 as shown in FIG. 2.

Piston 30 also slides within bore 15 of tool body 11. Piston 30 has an enlarged diameter upper end portion 31, a smaller diameter middle section 32, and an enlarged lower section 33. The piston 30 provides seals at 45 and 46. A bushing 34 mounted within the bore 15 of tool body 11 provides a guide for the smaller diameter middle section 32 of piston 30 as shown in FIGS. 1–3. Piston 30 provides a longitudinally extending flow channel 35 through which fluids can flow between the upper 31 and lower 33 sections of piston 30. In FIG. 1, arrow 36 illustrates the flow of fluids from bore 15 through flow channel 35 to a pair of diagonal channels 43, 44. Diagonal channels 43, 44 communicate with slots 41, 42 in tool body 11 as shown in FIG. 1. This enables fluid to be circulated.

Enlarged diameter upper end 31 of piston 30 provides a valve seat 37 that communicates with flow channel 35. The seat 37 receives ball valve 22 of valving member 20 moving down to engage piston 30.

Fluid can flow from a coil tubing string or work string through port 19 and to bore 15. This creates a pressure differential that moves valving member 20 downwardly so that the ball valving member 22 engages the seat 37 forming a seal. At this point, pressure differential above piston 30 causes the piston 30 and valving member 20 to move downwardly as a unit. As the valving member 20 and piston 30 move downwardly, both springs 28 and 40 are compressed to a greater and greater degree. Springs 28 and 40 are in a fully compressed position in FIG. 2.

The spring 28 provides a spring constant that fires the valving member 20 from its sealed position on piston 30 once the spring 28 has become fully compressed as shown in FIG. 2. When this happens, the ball valving member 22 is removed from seat 37 as shown in FIG. 3. This releases the differential pressure above piston 30 and enables spring 40 to thrust the piston 30 upwardly in the direction of arrows 61 as shown in FIG. 3. This upward movement of the piston creates a suction below enlarged lower section 33 of piston 30.

As the piston 30 moves upwardly in FIG. 3, debris that is positioned below intake 14 is suctioned into intake 14 as shown by arrows 53, 54 and then trapped by hinged catch fingers 56, 57. At the moment of upward travel off piston 30, the hinged catch fingers 56 and 57 assume an uppermost open position as shown in FIG. 3. After piston 30 reaches its uppermost position and has completed its travel, circulation continues through the tool body. The hinged catch fingers 56, 57 then pivot to their lowermost position as shown in FIGS. 1 and 2 trapping any debris that has traveled past the fingers 56, 57 and into the intake 14.

A cavity 47 is provided within the enlarged lower section 33 of piston 30 for containing ball valving member 48. The ball valving member 48 functions as a check valve, being urged against seat 50 with spring 49. When the piston 30 strokes downwardly, as shown in FIG. 2, the check ball valving member 48 comes off of seat 50 to allow the lower fluids to exhaust via slots 41, 42.

FIGS. 4–10 show a second embodiment of the apparatus of the present invention designated generally by the numeral 10B. The embodiment of 10B is shown in use in well tubing T wherein it is in the process of removing debris D that is blocking the well annulus A above an object O to be retrieved. The embodiment of FIGS. 4–10 is constructed in accordance with the preferred embodiment of FIGS. 1–3. The difference in construction between the embodiment of FIGS. 4–10 and the preferred embodiment of FIGS. 1–3 is the addition of retention magnets 62, magnetic staging points 63, and escalating members 64.

Figure 4:
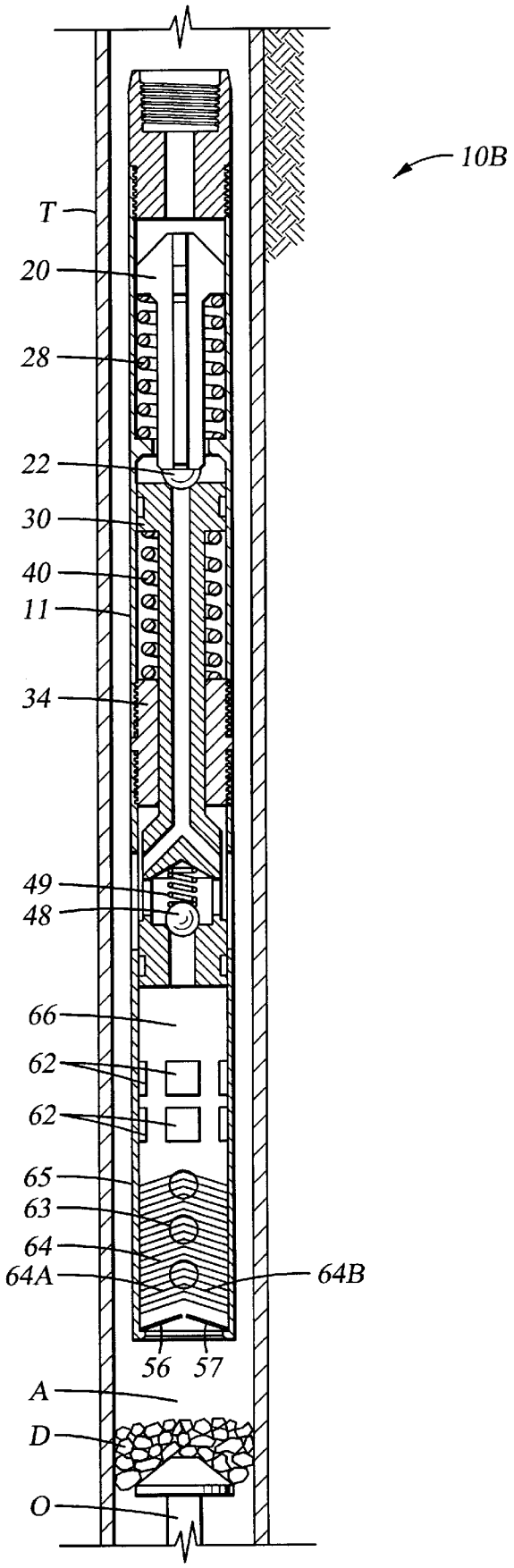
FIG. 4 is a sectional elevational view of a second embodiment of the apparatus of the present invention.
Figure 5:
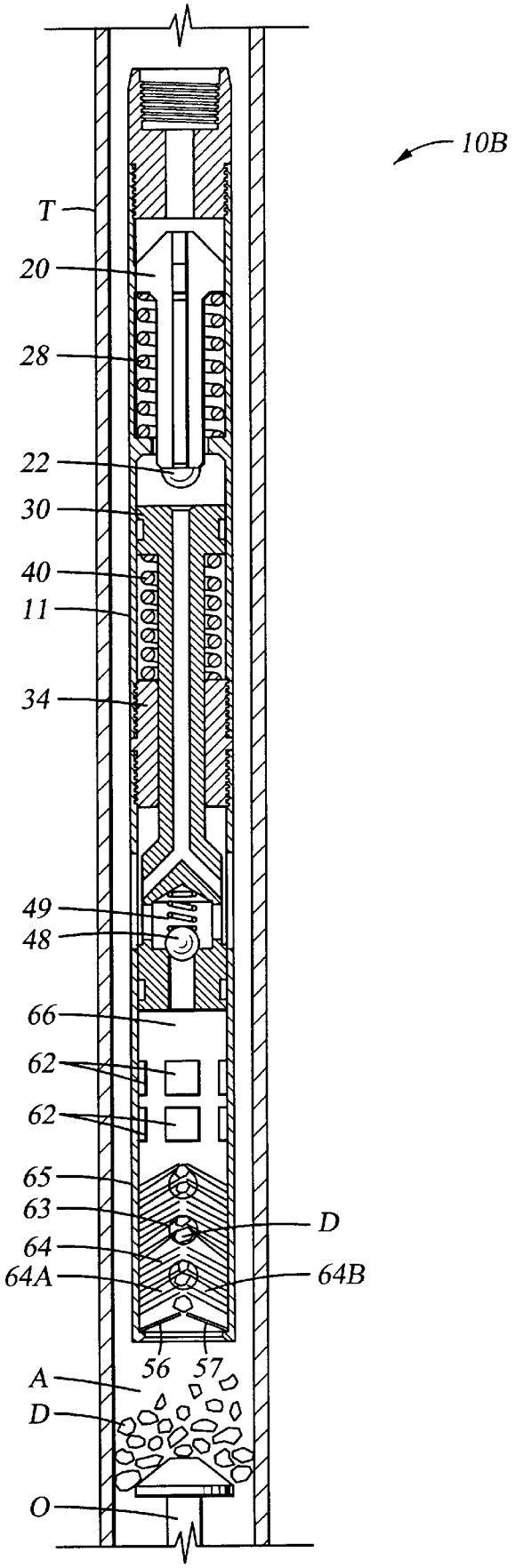
FIG. 5 is a sectional elevational view of the second embodiment of the apparatus of the present invention illustrating the lifting of debris into the tool body.

In the embodiment of FIGS. 4–10, an escalating tube 65 depends from the lower end of tool body 11 as shown in FIG. 4. The escalating tube 65 carries a plurality of escalating members 64 that can, for example, be stiff brush-like members that are inclined and opposed with respect to each other as shown in FIG. 4. Thus, the escalating members include a pair of opposed sets of escalating members designated generally by the numerals 64A and 64B in FIG. 4. Magnetic staging points 63 are shown in FIGS. 4–7 and 10. The magnetic staging points 63 are simply magnetic members attached to housing 11. These magnetic staging points 63 hold debris in place.

Figure 6:
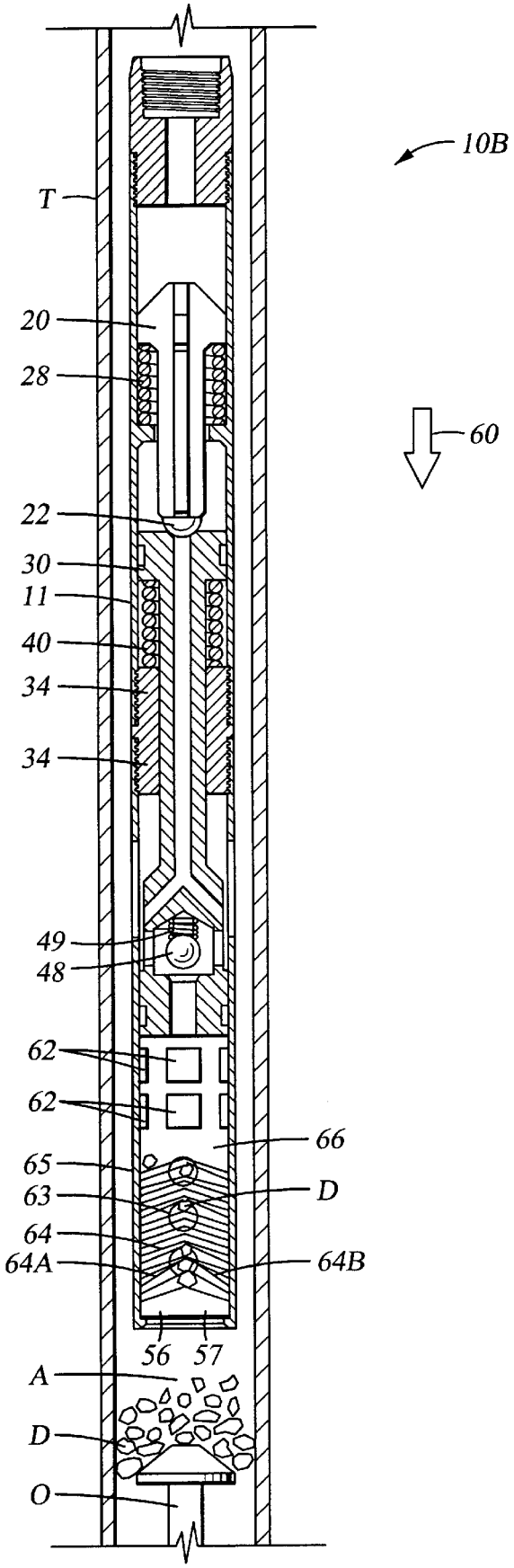
FIG. 6 is a sectional elevational view of the second embodiment of the apparatus of the present invention illustrating the movement of debris through the escalating members.
Figure 7:
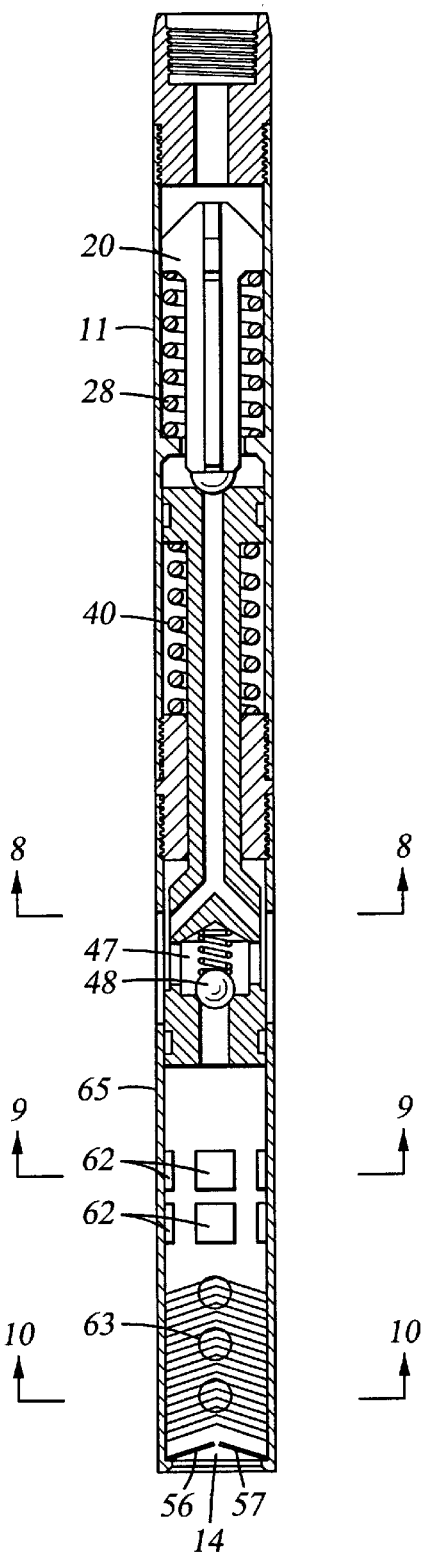
FIG. 7 is a sectional elevational view of a third embodiment of the apparatus of the present invention.
Figure 8:
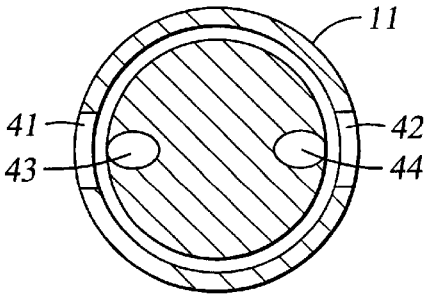
FIG. 8 is a sectional view taken along lines 8—8 of FIG. 7.
Figure 9:
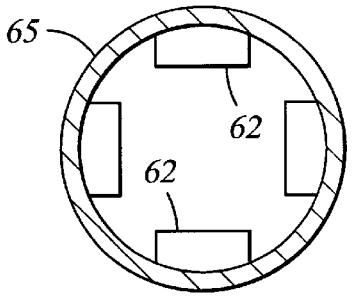
FIG. 9 is a sectional view taken along lines 9—9 of FIG. 7.
Figure 10:
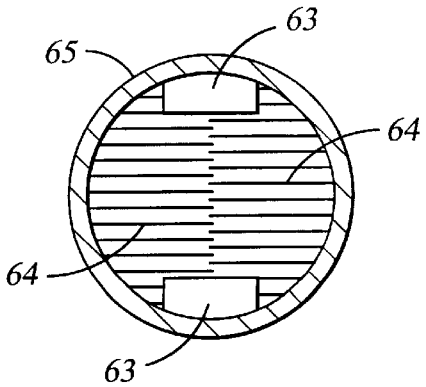
FIG. 10 is a sectional view taken along lines 10—10 of FIG. 7.

The staging points 63 are exposed to the lower chamber (eg. by a slot in the lower piston. The flexible fingers or brushes 64A, 64B move the debris from magnet to magnet of the staging points 63. This occurs in stages until the debris finally reaches the storage area. The fingers 64A, 64B urge debris to move upwardly in combination with the pumping action of the apparatus 10B which is the same of the pumping action of the preferred embodiment of FIGS. 1–3. When debris is moving upwardly in the escalating tube 65, the brush-like escalating members 64A, 64B grip and hold the debris D and urge it upwardly. With each stroke of the apparatus 10B, pumping action urges the individual pieces of the debris D upwardly as shown in FIG. 6. The escalating tube 65 reciprocates as it is attached to piston 30. Eventually, each element of debris D is held by a magnetic staging point 63. However, the escalating members 64A, 64B in FIG. 6 continue to push debris D upwardly in stages from magnet to magnet and toward the storage area at retention magnets 62. The retention magnets 62 hold elements of debris D at the upper end 66 of escalator tube 65 that is a void storage space area for containing a number of items of debris D at retention magnets 62.

Parts List

The following is a list of suitable parts and materials for the various elements of the preferred embodiment of the present invention.

| Part Number | Description |
|---|---|
| 10 | junk bailer apparatus |
| 10B | junk bailer apparatus |
| 11 | tool body |
| 12 | upper end portion |
| 13 | lower end |
| 14 | intake |
| 15 | longitudinal open ended bore |
| 16 | fitting |
| 17 | threaded connection |
| 18 | internal threads |
| 19 | flow port |
| 20 | valving member |
| 21 | lower end |
| 22 | ball valve |
| 23 | annular shoulder |
| 24 | opening |
| 25 | enlarged upper end |
| 26 | shoulder |
| 27 | rib |
| 28 | coil spring |
| 30 | piston |
| 31 | enlarged diameter upper end |
| 32 | smaller diameter middle section |
| 33 | enlarged lower section |
| 34 | bushing |
| 35 | flow channel |
| 36 | arrow |
| 37 | seat |
| 38 | annular shoulder |
| 39 | annular surface |
| 40 | coil spring |
| 41 | slot |
| 42 | slot |
| 43 | diagonal channel |
| 44 | diagonal channel |
| 45 | seal |
| 46 | seal |
| 47 | cavity |
| 48 | ball valving member |
| 49 | spring |
| 50 | seat |
| 51 | opening |
| 52 | opening |
| 53 | arrow |
| 54 | arrow |
| 56 | hinged catch fingers |
| 57 | hinged catch fingers |
| 58 | arrow |
| 59 | arrow |
| 60 | arrow |
| 61 | arrow |
| 62 | retention magnet |
| 63 | magnetic staging points |
| 64A | escalating members |
| 64B | escalating members |
| 65 | escalator tube |
| 66 | upper end of tube |
| A | well annulus |
| D | debris |
| O | object to be returned |
| T | well tubing |

The foregoing embodiments are presented by way of example only; the scope of the present invention is to be limited only by the following claims.

I claim:

1. An apparatus for removing debris from an oil and gas well having a well bore comprising:

a) a tool body having upper and lower end portions and a longitudinal bore;

b) a connector for attaching the upper portion of the tool body to a work string;

c) the lower end portion of the tool body having an intake portion for receiving debris that is to be removed from the well bore;

d) the bore containing a pump that enables fluid to be circulated from the well bore and into the tool bore via the intake portion;

e) the pump including a reciprocating piston member movable between upper and lower positions; and f) a fluid activated trap mechanism that catches debris that flows into the intake responsive to piston movement.

2. The apparatus of claim 1 wherein the trap mechanism includes fluid activated pivoting finger members positioned at the lower end portion of the tool body that are movable between open and closed positions, the fingers intaking debris when in the open position and trapping debris when in the closed position.

3. The apparatus of claim 2 wherein the pump generates fluid flow that sequentially opens and closes the pivoting finger members.

4. The apparatus of claim 1 wherein the pump includes a piston that slides within the tool body bore.

5. The apparatus of claim 1 wherein the tool body is generally cylindrically shaped and the intake is a generally cylindrically shaped cavity positioned at the lower end of the tool body bore.

6. The apparatus of claim 1 wherein the finger members include at least one flexible member.

7. The apparatus of claim 6 wherein the flexible member is a flexible brush.

8. The apparatus of claim 1 wherein the tool body includes a tubular housing portion with a side wall having at least one opening therethrough.

9. The apparatus of claim 8 wherein the pump circulates fluid from the intake portion through the sidewall opening.

10. The apparatus of claim 8 wherein there are a plurality of sidewall openings.

11. The apparatus of claim 8 wherein the sidewall opening is an elongated longitudinally extending slot.

12. An apparatus of removing debris from an oil and gas well having a well bore comprising:

a) a tool body having upper and lower end portions and a longitudinal bore;

b) a connector for attaching the upper portion of the tool body to a work string;

c) the lower end portion of the tool body having an intake portion for receiving debris that is to be removed from the well bore;

d) the bore containing a pump that enables fluid to be circulated from the well bore and into the tool bore via the intake portion;

e) wherein the pump includes a valving member that has upper and lower end portions, a piston that has upper and lower end portions and a piston bore the upper end of the piston having a seat for sealing the piston bore, and the lower end of the valve being movable to a sealing position on the piston seat to seal the piston bore; and f) the pump including a reciprocating piston member movable between upper and lower positions.

13. An apparatus for removing debris from and oil and gas well having a well bore, comprising:

a) a tool body having upper and lower end portions, a sidewall, and a longitudinal extended central flow bore;

b) a connector for attaching the upper portion of the tool body to a work string;

c) the lower end portion of the tool body having a cavity for holding debris and an intake portion that enables debris to travel from the well bore to the cavity;

d) a closure member at the intake portion for closing the cavity so that debris that enters the cavity is retarded from leaving the cavity via the intake portion;

e) a piston mounted within the bore and movable between upper and lower positions, a movement of the piston from the lower position to the upper position generating a mass of fluid flowing from the well bore just below the intake portion to the cavity for carrying debris therewith;

f) wherein the piston is operable with pressurized fluid that is transmitted to the tool body bore;

g) a valve member for controlling the flow of pressurized fluid to the piston, the valve member being movable so that its position controls whether or not the piston can be moved from the upper to the lower position;

h) a spring for urging the piston to travel toward the upper position;

i) a compressible valve member spring that expands to urge the valve member to separate from the piston, the valve member spring; and j) the piston spring, valve member spring and source of pressurized fluid defining a control for reciprocating the valve member in between sealed and released positions, and for moving the piston in sequence between upper and lower positions.

14. An apparatus for removing debris from and oil and gas well having a well bore, comprising:

a) a tool body having upper and lower end portions, a sidewall, and a longitudinally extended central flow bore;

b) a connector for attaching the upper portion of the tool body to a work string;

c) the lower end portion of the tool body having a cavity for holding debris and an intake portion that enables debris to travel from the well bore to the cavity;

d) a closure member at the intake portion for closing the cavity so that debris that enters the cavity is retarded from leaving the cavity via the intake portion;

e) a piston mounted within the bore and movable between upper and lower positions, a movement of the piston from the lower position to the upper position generating a mass of fluid flowing from the well bore just below the intake portion to the cavity for carrying debris therewith;

f) wherein the piston is operable to move from the upper to the lower position with pressurized fluid that is transmitted to the tool body bore;

g) a valve member for controlling the flow of pressurized fluid to the piston, the valve member being movable between sealed and unsealed positions so that the position of the valving member controls whether or not the piston can be moved with pressurized fluid from the upper to the lower position;

h) a piston spring for urging the piston to travel toward the upper position when the valve is in the unsealed position;

i) a compressible valve member spring that expands to urge the valve member to separate from the piston, the valve member spring generating sufficient force to separate the valve member and piston when the valve member spring is substantially fully compressed; and j) the piston spring, valve member spring and source of pressurized fluid defining a control for reciprocating the valve member in between sealed and released positions, and for moving the piston in sequence between upper and lower positions.

15. An apparatus for removing debris from an oil and gas well having a well bore comprising;

a) a tool body having upper and lower end portions and a longitudinal bore;

b) a connector for attaching the upper portion of the tool body to a work string;

c) the lower end portion of the tool body having an intake portion for receiving debris that is to be removed from the well bore;

d) the bore containing a pump that enables fluid to be circulated from the well bore and into the tool bore via the intake portion;

e) the pump including a reciprocating piston member movable between upper and lower positions; and f) a plurality of escalating members for catching the debris that flows into the intake response to piston movement.

16. An apparatus for removing debris from an oil and gas well having a well bore comprising:

a) a tool body having upper and lower end portions and a longitudinal bore;

b) a connector for attaching the upper portion of the tool body to a work string;

c) the lower end portion of the tool body having an intake portion for receiving debris that is to be removed from the well bore;

d) the bore containing a pump that enables fluid to be circulated from the well bore and into the tool bore via the intake portion;

e) the pump including a reciprocating piston member movable between upper and lower positions; and f) fluid activated means for catching the debris that flows into the intake.

17. An apparatus for removing debris from an oil and gas well having a well bore comprising:

a) a tool body having upper and lower end portions and a longitudinal bore;

b) a connector for attaching the upper portion of the tool body to a work string;

c) the lower end portion of the tool body having an intake portion for receiving debris that is to be removed from the well bore;

d) the bore containing a pump that enables fluid to be circulated from the well bore and into the tool bore via the intake portion;

e) the pump including a reciprocating piston member movable between upper and lower positions; and f) fluid activated reciprocating members position at the intake position for catching the debris that flows into intake.

18. An apparatus for removing debris from an oil and gas well having a well bore comprising:

a) a tool body having upper and lower end portions and a longitudinal bore;

b) a connector for attaching the upper portion of the tool body to a work string;

c) the lower end portion of the tool body having an intake portion for receiving debris that is to be removed from the well bore and a debris storage area;

d) the bore containing a pump that enables fluid to be circulated from the well bore and into the tool bore via the intake portion;

e) the pump including a reciprocating piston member movable between upper and lower positions;

f) a plurality of escalating members for catching and escalating the debris that flows into the intake portion responsive to piston movement; and g) staging magnet portions for holding debris within the tool body at stages in between the intake portion and the debris storage area.

19. An apparatus for removing debris from an oil and gas well having a well bore comprising:

a) a tool body having upper and lower end portions and a longitudinal bore;

b) a connector for attaching the upper portion of the tool body to a work string;

c) the lower end portion of the tool body having an intake portion for receiving debris that is to be removed from the well bore;

d) the bore containing a pump that enables fluid to be circulated from the well bore and into the tool bore via the intake portion;

e) the pump including a reciprocating piston member movable between upper and lower positions;

f) fluid activated escalating members for catching and elevating the debris that flows into the intake portion responsive to movement of the piston; and g) magnetic means for holding debris at stages as the debris is moved up by the fluid activated escalating members.

20. An apparatus for removing debris from an oil and gas well having a well bore comprising:

a) a tool body having upper and lower end portions and a longitudinal bore;

b) a connector for attaching the upper portion of the tool body to a work string;

c) the lower end portion of the tool body having an intake portion for receiving debris that is to be removed from the well bore;

d) the bore containing a pump for circulating fluid from the well bore and into the tool bore via the intake portion;

e) the pump including a reciprocating member movable between upper and lower positions;

f) a plurality of escalating fingers that move responsive to piston movement for catching and elevating the debris that flows into the intake; and g) staging magnets positioned above the intake for holding the debris at stages in between the intake and storage area.

21. An apparatus for removing debris from an oil and gas well having a well bore comprising:

a) a tool body having upper and lower end portions and a longitudinal bore;

b) a connector for attaching the upper portion of the tool body to a work string;

c) the lower end portion of the tool body having an intake portion for receiving debris that is to be removed from the well bore;

d) the bore containing a pump that enables fluid to be circulated from the well bore and into the tool bore via the intake portion;

e) the pump including a reciprocating piston member movable between upper and lower positions; and f) the lower end portion of the reciprocating piston member having an escalating device that moves up and down with the piston that escalates debris upwardly within the tool body responsive to reciprocating movement of the piston.

22. An apparatus for removing debris from an oil and gas well having a well bore comprising:

a) a tool body having upper and lower end portions and a longitudinal bore;

b) a connector for attaching the upper portion of the tool body to work a string;

c) the lower end portion of the tool body having an intake portion for receiving debris that is to be removed from the well bore;

d) the bore containing a pump that enables fluid to be circulated from the well bore and into the tool bore via the intake portion;

e) the pump including a reciprocating piston member movable between upper and lower positions; and f) further comprising a cavity within the tool body for holding debris, wherein the piston supports a fluid activated trap mechanism at its lower end portion that moves with the piston and generates a mass of fluid flowing upwardly in the tool body, enabling debris to enter the cavity.

* * * * *